US005662753A

United States Patent [19]

Loos

[11] Patent Number: 5,662,753

[45] Date of Patent: Sep. 2, 1997

[54] INSTALLATION OF MOLDINGS

[76] Inventor: James H. Loos, 4742 Paseo Tubutama, Tucson, Ariz. 85715

[21] Appl. No.: 469,533

[22] Filed: Dec. 5, 1994

[51] Int. Cl.[6] ..... E04F 19/04

[52] U.S. Cl. ..... 156/71; 52/287.1; 264/35; 425/458

[58] Field of Search ..... 156/71; 52/287.1, 52/716.4, 717.05, 741.1; 264/35; 249/15; 425/458, 87, 318

[56] References Cited

U.S. PATENT DOCUMENTS

| | | | |
|---|---|---|---|
| 717,545 | 1/1903 | Conkling | 425/458 |
| 855,633 | 6/1907 | Herring | 425/458 |
| 3,341,878 | 9/1967 | Hubbard | 425/458 |
| 4,315,390 | 2/1982 | Schaafsma | 52/287.1 |
| 4,520,605 | 6/1985 | Budd | 52/287.1 |
| 4,601,149 | 7/1986 | Dokan | 52/287.1 |
| 4,835,916 | 6/1989 | Steadman | 52/287.1 |
| 4,977,718 | 12/1990 | Hoffman | 52/287.1 |
| 5,073,430 | 12/1991 | Aidan | 52/287.1 |

FOREIGN PATENT DOCUMENTS

| | | | |
|---|---|---|---|
| 0845206 | 8/1960 | United Kingdom | 52/287.1 |
| 20314778 | 4/1980 | United Kingdom | 52/287.1 |
| 2190115 | 11/1987 | United Kingdom | 52/717.05 |
| 2191518 | 12/1987 | United Kingdom | 52/287.1 |

OTHER PUBLICATIONS

Georgia–Pacific Corp., Lit. Item #141500, "Combination Moulding Designs," May 1992.

Armstrong World Ind., Inc., Brochure Ft–21–5931, "Armstrong Finishing Touches . . . ," 1993.

*Primary Examiner*—Daniel Stemmer

*Attorney, Agent, or Firm*—Antonio R. Durando

[57] ABSTRACT

An elongated molding for covering the corner at the junction of a wall and a ceiling has a pair of longitudinally extending margins each of which is provided with a recess. Both recesses are bordered by a pair of longitudinal surface portions, and the surface portions flanking one recess are to abut or be bonded to the wall while the surface portions flanking the other recess are to abut or be bonded to the ceiling. The molding has a front side which is to face away from the wall and the ceiling, and the surface portion of each pair nearest the front side adjoins a bevel which is located between the respective surface portion and the front side. The molding is bonded to the wall and the ceiling by joint compound or spackling compound placed in the recesses. The bevels define gaps with the wall and the ceiling, respectively, and such gaps are filled with joint compound or spackling compound to enhance bonding. A plaster coating may be run in place on the molding and the molding is then provided with guide surfaces for the shaping tool which contours the coating. The front side of the molding can be formed with anchoring elements for the coating.

7 Claims, 2 Drawing Sheets

INSTALLATION OF MOLDINGS

BACKGROUND OF THE INVENTION

1. Field of the Invention

The invention relates to moldings and the installation of moldings.

2. Description of the Prior Art

Moldings are widely used to enhance the appearance of home interiors, and different kinds of moldings are available to suit different requirements. Thus, one kind of molding commonly employed serves mainly to hide gaps in corners and to protect corners from direct contact with people and objects. A more exclusive kind of molding has primarily an ornamental purpose.

Two general types of ornamental moldings exist. The first type of ornamental molding, which requires little skill to install, is made of wood or plastic. These moldings can be readily cut and are usually mounted on a wall and/or ceiling by means of nails or adhesive. Moldings of this type are disclosed, for instance, in Lit. Item #111500 of Georgia-Pacific Corporation entitled "Combination Moulding Designs" (May 1992) and brochure FT-210-5931 of Armstrong World Industries, Inc. entitled "Armstrong Finishing Touches—Mouldings and Medallions" (1993).

The second type of ornamental molding is made of plaster and requires a relatively high skill level for installation. Plaster moldings are produced in basically two ways. On the one hand, they can be run in place on a wall or ceiling or run on a bench. On the other hand, they can be cast in a stationary mold.

A run-in-place molding is made using a template which has the negative of the desired profile of the molding. Wet plaster is troweled onto the area which is to be provided with the molding and the template is thereupon run over the plaster. In order to guide the template, it is necessary to install wooden tracks adjacent the area being worked on. This is a difficult and time-consuming operation. Furthermore, if the molding is less than 1 inch thick, a bonding agent must be painted onto the area to be provided with the molding to increase adhesion. Even more work is required when the thickness of the molding exceeds 1 inch since the area being worked on then needs to be built out with blocks and covered with a wire lath.

The run-on-a-bench technique differs from the run-in-place technique in that the molding is produced on a special bench rather than in place. Depending upon its size, a run-on-a-bench molding can be directly mounted on a surface by means of a slip of gypsum plaster or can be installed in a backing box and nailed or screwed into studs, joists or a lath. Cast plaster moldings are likewise mounted differently depending on weight with plaster of paris, mastic adhesive, epoxy or gypsum board being used for lighter moldings and screws for heavier moldings.

When ornamental moldings are installed using nails or screws, the resulting holes must be filled and the filler smoothed by sanding. Since this entails a considerable amount or work, it is desirable to mount the moldings adhesively.

To reduce the number of materials required during the installation of moldings, the bonding agent for adhesive attachment of the moldings is preferably the same plaster-based material used to fill the joints between moldings. Inasmuch as plaster shrinks when it dries, a relatively great thickness of plaster-based material is necessary to achieve a good bond. To date, however, the art does not appear to have devised a bonding technique employing thick layers of plaster-based material.

BRIEF SUMMARY OF THE INVENTION

It is an object of the invention to provide a molding which can be securely mounted with relative ease.

Another object of the invention is to provide a molding which is capable of being firmly bonded even when the bonding agent shrinks while drying or curing.

An additional object of the invention is to provide a molding which makes it possible to simplify the run-in-place technique.

A further object of the invention is to provide a method which allows a molding to be firmly mounted in a relatively simple manner.

It is also an object of the invention to provide a method which permits a molding to be securely bonded even when the bonding agent shrinks during drying or curing.

Yet another object of the invention is to provide a method which can facilitate the run-in-place technique.

The preceding objects, as well as others which will become apparent as the description proceeds, are achieved by the invention.

One aspect of the invention resides in a molding comprising an integral shaped body having a pair of opposed marginal portions. Each of the marginal portions is provided with a recess arranged to open to a support structure for the body, and a pair of surface portions which are designed to abut or be bonded to the support structure and border the respective recess on at least two sides.

By appropriate design of the recesses, two effects can be obtained. On the one hand, the surface area of the molding available for bonding can be increased. On the other hand, room can be created for a relatively thick layer of a bonding agent so that, even if the bonding agent shrinks while drying or curing, a good bond is achieved. Since recesses are provided on two opposed marginal portions of the molding, the molding can be attached to each of two surfaces defining a corner, e.g., to a wall and a ceiling.

Another aspect of the invention resides in a molding comprising a shaped body having a marginal portion which is provided with a first surface portion designed to abut or be bonded to a support structure for the body. The body has a predetermined side which is arranged to face away from the support structure, and the marginal portion is further provided with a second surface portion which bridges the predetermined side and the first surface portion. The second surface portion includes a section which contacts the first surface portion along a common edge, and such section defines an angle greater than 90 degrees with the first surface portion.

When the first surface portion is placed against a support structure, the support structure and the indicated section of the second surface portion form a gap. A bonding agent can be introduced into this gap to establish a connection, or an additional connection, between the support structure and the marginal portion of the molding. The gap can be made large enough to accommodate a substantial thickness of the bonding agent thereby permitting a strong bond to be produced even if the bonding agent shrinks during drying or curing.

An additional aspect of the invention resides in a molding comprising a shaped body having a first side designed to face a support structure for the body and a second side designed to face away from the support structure. The second side is provided with an anchoring element for a coating.

The anchoring element enables a coating to be run in place on the molding without special preparation to hold the coating in position. Moreover, by running in place on the molding, it may be possible to eliminate at least some of the surface preparation normally required for the run-in-place technique. If the coating consists of plaster and is ornamental, the molding allows the look of a thick plaster ornament to be achieved with a relatively thin layer of plaster.

A further aspect of the invention resides in an ornamenting method comprising the steps of at least partly recessing a substance having adhesive properties in a molding, and attaching the molding to a support structure using the substance.

One more aspect of the invention resides in an ornamenting method which comprises the step of positioning a molding having a marginal portion against a support structure to form an exposed gap between the marginal portion and the support structure. The method additionally comprises the step of at least partially filling the gap with a substance having adhesive properties to establish a bond between the support structure and the marginal portion of the molding.

Yet another aspect of the invention resides in an ornamenting method comprising the steps of attaching a molding to a support structure, applying a flowable material to the molding, shaping the flowable material by moving a tool over the molding, and guiding the tool on the molding during the shaping step.

Still a further aspect of the invention resides in an ornamenting method which comprises the steps of attaching a molding to a support structure, applying a coating to the molding, and mechanically anchoring the coating to the molding.

BRIEF DESCRIPTION OF THE DRAWINGS

Additional features and advantages of the invention will be forthcoming from the following detailed description of preferred embodiments when read in conjunction with the accompanying drawings.

DESCRIPTION OF THE PREFERRED EMBODIMENTS

Figure 1:
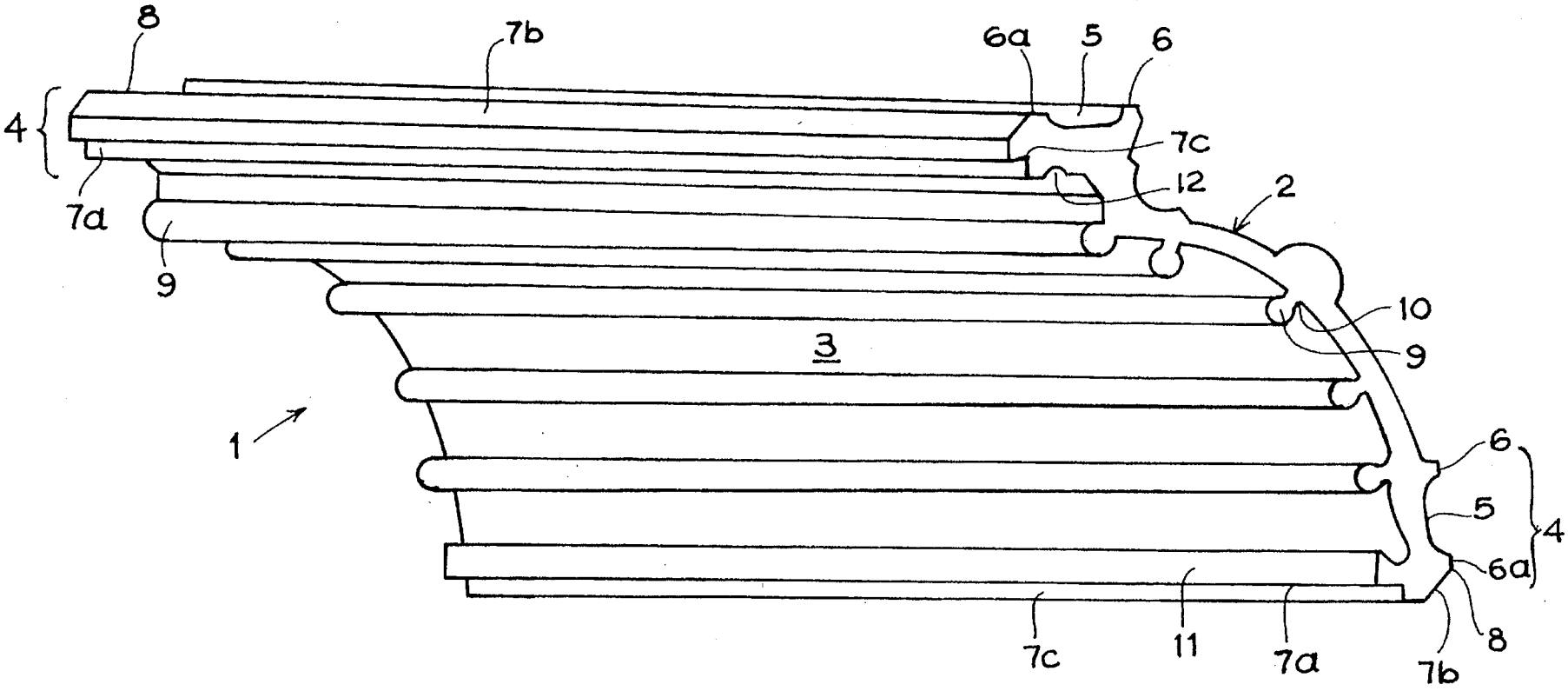
FIG. 1 is a perspective view of a molding in accordance with the invention.
Figure 2:
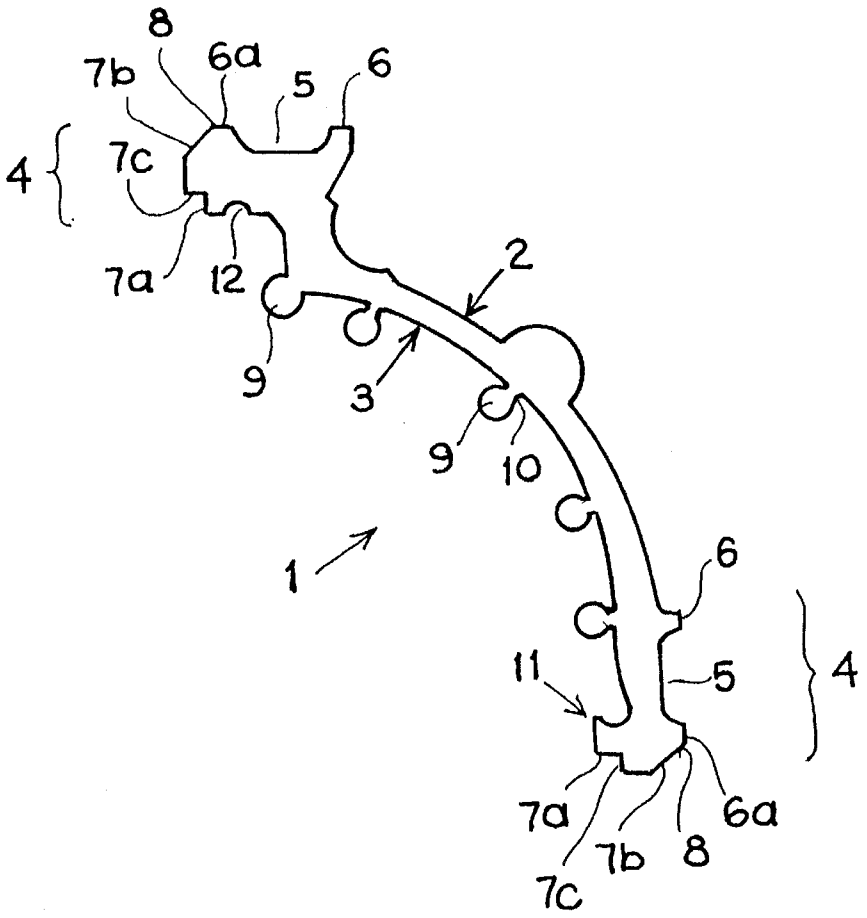
FIG. 2 is a side view of the molding of FIG. 1.

With reference to FIGS. 1 and 2, a molding according to the invention is generally identified by the numeral 1. The molding 1, which is constituted by an elongated, integral, shaped or profiled body, has a side 2 which is designed to face a support structure on which the molding 1 is mounted and a side 3 which is designed to face away from the support structure. For ease of description, the side 2 of the molding 1 will be referred to as the rear side and the side 3 as the front side.

The molding 1 is provided with a pair of opposite margins or marginal portions 4 which extend longitudinally of the molding 1. The margins 4 are formed with respective recesses 5 which likewise extend longitudinally of the molding 1. Each of the recesses 5 is bordered by two flat surface portions 6 and **6*a* which are disposed on opposite sides of the associated recess 5 and also extend longitudinally of the molding 1. The surface portions 6,6*a* are designed to abut or be bonded to a support structure on which the molding 1 is mounted. The recesses 5**, which may be arcuate or may include arcuate segments as shown, have longitudinally extending open sides arranged to face the support structure.

The front side 3 of the molding 1 is closer to the surface portions **6*a* than to the surface portions 6. Each of the margins 4 has a surface portion in addition to the surface portions 6,6*a*, and these additional surface portions bridge the surface portions 6*a* and the front side 3. The additional surface portions are here made up of several sections which extend longitudinally of the molding 1, and such sections include a flat section 7*a* and a flat section 7*b*. The flat sections 7*a* constitute guide surfaces for a shaping tool or template of the type used for run-in-place ornamenting. The flat sections 7*b*, which may be considered to constitute bevels, contact the surface portions 6*a* along common edges 8. Each of the bevels 7*b* defines an angle greater than 90 degrees with the respective surface portion 6*a***.

The front side 3 of the molding 1 is provided with a series of projections which extend longitudinally of the molding 1. The projections include rod-shaped members 9 which can be affixed directly to the front side 3 or can be mounted on the front side 3 via stems 10. The projections 9,10 constitute anchoring elements for a coating or layer of hardened material, such as plaster, which may be applied to the front side 3. The lower margin 4 of the molding 1 is provided with an additional anchoring element in the form of a longitudinally extending hook-like member 11 while the upper margin 4 is provided with an additional anchoring element in the form of a longitudinally extending groove 12. The various types of anchoring elements are interchangeable and any of these types can be used alone or in combination with one or both of the other types.

The anchoring elements 9,10,11,12 are optional. The molding 1 can be used without a coating and, in such an event, the anchoring elements 9,10,11,12 may be eliminated. If desired, the front side 3 of the molding 1 can then be provided with decorative elements.

The molding 1 can be constituted by an extrusion. The molding 1 may be composed of an expanded or foamed material with ABS, styrene and polystyrene being preferred. It is also possible to make the molding 1 with extruded polystyrene such as the material marketed by Dow Chemical Company under the trademark Styrofoam®.

The manner of using the molding 1 will be described with reference to FIG. 3 assuming that the front side 3 of the molding 1 is to be provided with a coating. It is further assumed that the molding 1 is to provide an ornamental cover for the corner defined by a ceiling and a wall of a room.

Figure 3:
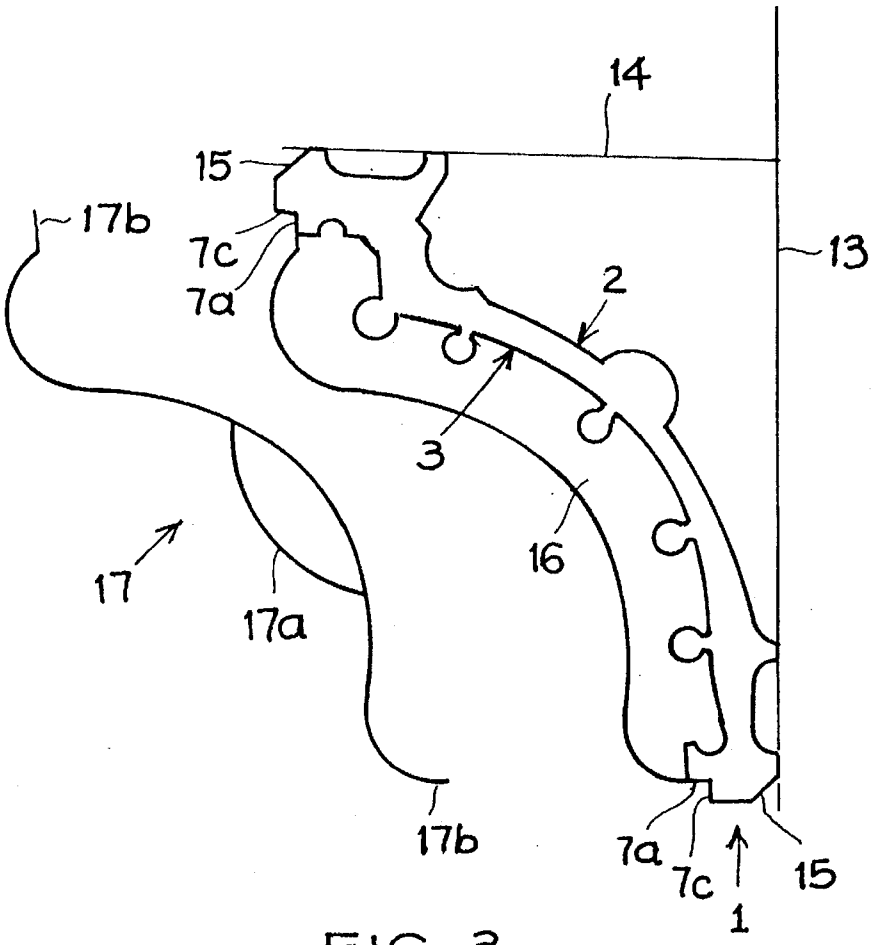
FIG. 3 is a side view illustrating the mounting of the molding of FIG. 1 on a structure and the coating of the molding with a decorative layer.

In FIG. 3, the numeral 13 identifies the wall and the numeral 14 the ceiling. The wall 13 and the ceiling 14 constitute, or constitute part of, a support structure for the molding 1.

The surfaces of the wall 13 and ceiling 14 are prepared as necessary to bond the molding 1 to the wall 13 and the ceiling 14. The preparation can be entirely conventional.

Once the surfaces of the wall 13 and the ceiling 14 have been prepared, the recesses 5 of the molding 1 are filled with a flowable substance which has adhesive properties and dries or cures to a hardened state. By way of example, this bonding substance can be a joint compound, a spackling compound or plaster. An excess of the bonding substance will normally be placed in the recesses 5 to assure that the bonding substance established good contact with the wall 13 and the ceiling 14. The molding 1 is positioned with the rear side of the molding 1 facing the wall 13 and the ceiling 14, and the surface portions 6,6*a* of the upper margin 4 of the molding 1 are pressed against the ceiling 14 while the surface portions 6,6*a* of the lower margin 4 of the molding 1 are pressed against the wall 13. Excess bonding substance squeezed out of the ends of the recesses 5 may be removed in any convenient manner. It is possible that small quantities of the bonding substance will be squeezed between the wall 13 and the surface portions 6,6*a* of the lower margin 4 of the molding 1 as well as between the ceiling 14 and the surface portions 6,6*a* of the upper margin 4 of the molding 1. This is of no consequence and, when the molding 1 is in its final position, the surface portions 6,6*a* may either abut the wall 13 and the ceiling 14 or be bonded to the wall 13 and the ceiling 14.

The bevel 7*b*, which may be flat (as shown in the figure) or curved, of the lower margin 4 of the molding 1 defines a gap 15 with the wall 13 and, similarly, the bevel 7*b* of the upper margin 4 of the molding 1 defines a gap 15 with the ceiling 14. The gaps 15 are likewise filled with a flowable substance which has adhesive properties and dries or cures to a hardened state. The substance used in the gaps 15 may be the same as that used in the recesses 5. After the gaps 15 have been filled, the bonding substance in the gaps 15 may be smoothed in a conventional fashion.

When the bonding substance in the recesses 5 and the gaps 15 dries or cures, the molding 1 is firmly attached to the wall 13 and the ceiling 14. Note that the bonding substance in the gaps 15 becomes an integral part of the finished molding.

Following mounting of the molding 1 on the wall 13 and the ceiling 14, the front side 3 of the molding 1 is provided with an ornamental coating or veneer 16. Thus, a flowable material which dries or cures to a hardened state is applied to the front side 3 of the molding 1 using a trowel or some other suitable implement. The flowable material used to create the coating 16 is preferably plaster, applied in one layer or multiple successive layers.

The coating 16 is run in place using a shaping tool or template 17 which is provided with a handle 17*a* and has a contour complementary to the desired contour of the coating 16. The coating 16 is run in place in the usual manner with the exception that the shaping tool 17 is guided on the molding 1 rather than on special tracks temporarily installed on the wall 13 and ceiling 14. To this end, the shaping tool 17 is provided with a pair of flat guide surfaces 17*b* which are designed to run along the respective guide surfaces 7*a* of the molding 1 as the chaping tool 17 contours the coating 16. Depending on the characteristics and specific shape of the shaping tool 17, either the wall and/or ceiling surfaces or abutting surfaces 7*c* provide the necessary support to establish the thickness of the coating 16.

As the flowable material of the coating 16 is applied to the molding 1, the material flows around the rod-shaped anchoring members 9 and the hook-shaped anchoring member 11 as well as into the anchoring groove 12. Consequently, once the material has dried or cured, the coating 16 is mechanically anchored to and securely held on the molding 1 by the anchoring elements 9,10,11,12.

The recesses 5 of the molding 1 provide at least two desirable effects. On the one hand, the recesses 5 increase the surface area of the molding 1 available for bonding. On the other hand, the recesses 5 make it possible to use a substantial thickness of bonding agent so that, even if the bonding agent shrinks while drying or curing, a good bond is nevertheless achieved. This is the case for plaster and joint compound, the preferred materials used for forming and finishing molding applications. These materials, which require pressure during application, shrink noticeably during curing, providing what is referred to in the art as suction bonding.

The bevels 7*b* of the molding 1 function to create the gaps 15 between the ceiling 14 and the upper margin 4 of the molding 1, and between the wall 13 and the lower margin 4 of the molding 1. Similarly to the recesses 5, the gaps 15 can accommodate a significant thickness of bonding agent thereby permitting strong bonds to form despite the fact that the bonding agent may undergo shrinkage during drying or curing, as is the case when plaster and joint compound are used. The gaps 15 enable the adhesion of the margins 4 to the wall 13 and ceiling 14 to be enhanced.

The guide margins 7*a* of the molding 1 allow the run-in-place technique to be greatly facilitated. Thus, the guide surfaces 7*a* eliminate the need to install special tracks on the wall 13 and ceiling 14 for the guidance of the shaping tool 17.

The use of the molding 1 as a substrate for the coating 16 makes it possible to achieve the look of a deep or thick run-in-place ornament with a relatively small thickness of the coating 16. This enables much of the difficulty associated with the deep or thick run-in-place ornaments of the prior art to be avoided. The molding 1 may also permit elimination of some of the surface preparation required for conventional run-in-place ornaments.

The anchoring elements 9,10,11,12 provide a simple means for securely holding the coating 16 in position. The action of the anchoring elements 9,10,11,12 is mechanical and does not require bonding agents.

Various modifications can be made within the meaning and range of equivalence of the appended claims.

I claim:

1. An ornamenting method, comprising the steps of: at least partly recessing a substance having adhesive properties in a molding; attaching said molding to a support structure using said substance, said molding having a side which faces away from said support structure; applying a flowable material to said side of said molding; shaping said flowable material by moving a tool over said molding; and guiding said tool on said molding during the shaping step, said tool having at least one tool guide surface and said molding having at least one molding guide surface, and the guiding step including moving said at least one tool guide surface along said at least one molding guide surface.

2. The method of claim 1, wherein said molding has a marginal portion and the attaching step includes forming an exposed gap between said marginal portion and said support structure; and further comprising the step of at least partially filling said gap with a material having adhesive properties to establish a bond between said marginal portion and said support structure.

3. The method of claim 2, wherein said substance and said material are the same.

4. The method of claim 1, wherein said substance comprises plaster.

5. The method of claim 1, wherein said substance comprises joint compound or spackling compound.

6. The method of claim 1, wherein said molding comprises a foamed material.

7. The method of claim 6, wherein said foamed material comprises a member of the group consisting of ABS, styrene and polystyrene.

* * * * *